US008347589B2

(12) United States Patent
Duquet

(10) Patent No.: US 8,347,589 B2
(45) Date of Patent: Jan. 8, 2013

(54) METHOD OF PACKAGING DISPENSER ASSEMBLY

(75) Inventor: Frederic Duquet, Thibouville (FR)

(73) Assignee: Aptar France SAS, Le Neubourg (FR)

( * ) Notice: Subject to any disclaimer, the term of this patent is extended or adjusted under 35 U.S.C. 154(b) by 438 days.

(21) Appl. No.: 12/633,427

(22) Filed: Dec. 8, 2009

(65) Prior Publication Data

US 2010/0139212 A1 Jun. 10, 2010

Related U.S. Application Data

(60) Provisional application No. 61/165,683, filed on Apr. 1, 2009.

(30) Foreign Application Priority Data

Dec. 9, 2008 (FR) ..... 08 58392

(51) Int. Cl.
*B65B 65/00* (2006.01)

(52) U.S. Cl. ..... 53/446; 53/448

(58) Field of Classification Search ..... 53/446, 53/447, 448

See application file for complete search history.

(56) References Cited

U.S. PATENT DOCUMENTS

| | | | | | |
|---|---|---|---|---|---|
| 2,318,452 | A | * | 5/1943 | Berg | 206/45.29 |
| 3,608,705 | A | * | 9/1971 | Moshel | 206/461 |
| 3,989,139 | A | * | 11/1976 | Vargo | 206/778 |
| 4,562,922 | A | | 1/1986 | Midura | |
| 6,016,906 | A | * | 1/2000 | Kruse et al. | 206/77.1 |

FOREIGN PATENT DOCUMENTS

| | | | |
|---|---|---|---|
| EP | 0 897 874 | A1 | 2/1999 |
| FR | 2 862 614 | A1 | 5/2005 |
| GB | 2 440 733 | A | 2/2008 |
| JP | 2005-093334 | A | 4/2005 |

* cited by examiner

*Primary Examiner* — Hemant M Desai

(74) *Attorney, Agent, or Firm* — Sughrue Mion, PLLC

(57) ABSTRACT

A method of packaging dispenser assemblies, the method comprising forming a group of n dispenser assemblies, disposed in such a manner that the flaps are stacked and the housings are in side-by-side alignment and oriented in the same direction. When arranged in this way, the dispensers remain visible through the large windows formed in their respective housings.

8 Claims, 2 Drawing Sheets

METHOD OF PACKAGING DISPENSER ASSEMBLY

CROSS REFERENCE TO RELATED APPLICATION

This application claims the benefit under 35 U.S.C. §119 (e) of U.S. provisional patent application Ser. No. 61/165,683, filed Apr. 1, 2009, and priority under 35 U.S.C. §119(a)-(d) of French patent application No. FR-08.58392, filed Dec. 9, 2008.

TECHNICAL FIELD

The present invention relates to a dispenser assembly comprising a fluid dispenser and a package in which the dispenser is inserted. Such a dispenser assembly is particularly useful in the field of perfumery, or indeed of cosmetics, as a sample that is generally given away freely to the purchaser of a specialized magazine. The dispenser comprises a reservoir of very small capacity associated with a stopper or a dispenser member such as a pump. The invention also relates to a packaging method that enables the dispenser assemblies of the present invention to be packaged in advantageous manner.

BACKGROUND OF THE INVENTION

In the prior art, document FR-2 862 614 discloses a dispenser assembly comprising a fluid dispenser that is generally cylindrical in shape and that is associated with a package defining two separate flaps that are connected together by a spine in which there is formed a loop through which the fluid dispenser is engaged. The loop is formed by two cuts across the spine to define a strip that is shaped in such a manner as to form the loop for the fluid dispenser. Consequently, when the package is closed, the spine presents an unsightly window for which the user cannot directly see any purpose. The two flaps and the spine are hinged like the cover of a book so that, in the closed state, the two flaps are disposed substantially parallel to each other. Nevertheless, this is not strictly true given that the free side edges of the flaps tend to come into contact, while their opposite edges that are connected to the spine are kept apart because the fluid dispenser is located between them. This gives the dispenser assembly a section that is more triangular in shape and that is not genuinely attractive. Furthermore, such a dispenser assembly is particularly expensive to make, given that it is necessary for it to be printed on both faces. In other words, the packaging is made from a single sheet that is folded to form the two flaps and the spine, but that sheet needs to have printing on both faces in order to produce a suitably attractive appearance. Another problem with that dispenser assembly is that the loop used for holding the dispenser is of very small width, such that the dispenser is not securely held and can pivot about the loop. It can thus happen that the dispenser is lost on opening the package.

Furthermore, that document FR-2 862 614 describes a packaging method that enables a plurality of dispenser assemblies to be packaged in a more or less compact manner. The packaging method recommends stacking the dispenser assemblies one in another like goblets or pots. More precisely, a dispenser assembly is inserted between the two flaps of another dispenser assembly until its own spine comes into contact with the dispenser of the other assembly. Other dispenser assemblies are inserted in the same manner, so that the dispensers are disposed side by side with the same orientation, and their flaps are superposed but offset on either side of the row of dispensers. Nevertheless, that packaging method presents the drawback that several flaps or flap portions project freely without there being any dispenser between them, which makes them particularly fragile, particularly in terms of their corners becoming folded. Consequently, all of the dispenser assemblies as packaged in that way are not in exactly the same condition, since those package assemblies that were engaged last have their flaps that are more exposed. As a result these last-packaged dispenser assemblies are often damaged and unusable.

From U.S. Pat. No. 4,562,922 and EP-0 897 874 are also known packages comprising a housing and a side flap. These packages are not adapted to be packaged together in a compact manner without damage risks.

BRIEF SUMMARY OF THE INVENTION

An object of the present invention is to remedy the above-mentioned drawbacks of the prior art by defining a novel type of dispenser assembly that is simple to fabricate and that enables particularly advantageous packaging to be implemented with particularly little risk of damage. Another object of the present invention is to minimize the cost of producing a dispenser assembly, in particular in terms of printing costs.

To do this, the present invention provides a dispenser assembly characterized in that it comprises: a fluid dispenser of generally cylindrical shape; and a package defining a housing for the dispenser and a single side flap that extends from one side of the housing from a bottom side edge of the housing, such that the housing projects entirely from one side only of the plane defined by the flap. Unlike the dispenser assembly of the above-mentioned prior art document, the assembly of the present invention has only one side flap defining a plane from which there is formed a housing containing the fluid dispenser.

In an advantageous embodiment, the housing presents a cross-section that is substantially a square of side U, the flap presenting a height parallel to the bottom side edge and a width l perpendicular to the edge, the width l corresponding substantially to a multiple of U. This characteristic, which at first glance appears insignificant, is nevertheless particularly advantageous in terms of packaging the dispenser assemblies, as explained below with reference to the packaging method.

According to another advantageous aspect of the invention, the housing includes blocking means for retaining the dispenser in the housing, and a window through which the major fraction of the dispenser is visible. In the above-mentioned prior art document, the dispenser is clearly visible inside the two flaps, but it is practically invisible when the flaps are closed one on the other. In the present invention there is no need to manipulate the package in order to see a major fraction of the dispenser, and thus easily identify its appearance.

In a particularly practical embodiment, the package is made from a single sheet folded in half so that the flap is formed by superposing two strips of the sheet, with the housing being formed by a closed loop of the sheet. The housing may thus be in the form of a case in which the dispenser is well held. The window in the case may be very large so that the case covers only two opposite ends of the dispenser, while leaving the major fraction thereof visible. Another associated advantage is that it is possible to use a sheet of small weight, given that the stiffness of the side flaps comes mainly from superposing sheet strips (possibly reinforced by the presence of adhesive or heat-sealing), and not solely from the intrinsic stiffness of the sheet.

According to another advantageous characteristic of the invention, the sheet is printed on only one of its faces. There is no need to print its other face since the sheet is folded in half and this face is therefore not visible.

The invention also provides a method of packaging dispenser assemblies as defined above, the method comprising forming a group of n dispenser assemblies disposed in such a manner that the flaps are stacked and the housings are in side-by-side alignment and oriented in the same direction. When arranged in this way, the dispensers remain visible through the large windows formed in their respective housings.

According to another characteristic of the method, n corresponds substantially to l/U. By way of example, the side U of the housing may measure 1 centimeter (cm), the width of the flaps can then be set at 4 cm, and the number of packaged dispenser assemblies is then equal to four, i.e. n=4.

According to another advantageous aspect of the method, it comprises forming a row constituted by two identical groups disposed in an opposite ways round configuration such that the stacked flaps of one group extend over the aligned housings of the other group, and vice versa, so that all of the housings are in side-by-side alignment, but differently oriented from one group to the other. When n is selected to be equal to the multiple of U corresponding to the flap, for example when this multiple is 4, the row comprises two groups of four dispenser assemblies disposed opposite ways round with the windows of the four housings in the first group being oriented upwards and the windows in the four housings in the other groups being oriented downwards. With this configuration, the flaps do not project sideways beyond the housings in a row. Since the width of the flaps corresponds to four times the side U and since there are four dispenser assemblies per group, the free side edge of the furthest-forward dispenser assembly does not project beyond the housing of the last dispenser assembly. More mathematically, it can be said that the width of the flap is less than n×U.

By virtue of this configuration in rows, it is possible to stack m rows of m×2×n dispenser assemblies so as to form a compact block or bundle of m×2×n: m may be equal to or different from n. When equal, a block of $2\times n^2$ dispenser assemblies is obtained. Taking by way of example n=4, it is possible to form a compact block of 64 dispenser assemblies having a side of less than 10 cm. Given that the flaps do not project beyond the housings, there is no risk of the flaps being damaged or becoming dog-eared. All of the dispenser assemblies of the block are thus in substantially the same condition concerning their exposure to risks of being damaged.

It should be observed that the packaging method of the present invention is associated directly with the particular design of the dispenser assembly having only one side flap.

BRIEF DESCRIPTION OF THE DRAWINGS

The invention is described in greater detail below with reference to the accompanying drawings, showing an embodiment of the invention by way of non-limiting example.

In the figures.

DETAILED DESCRIPTION OF THE INVENTION

Figure 1:
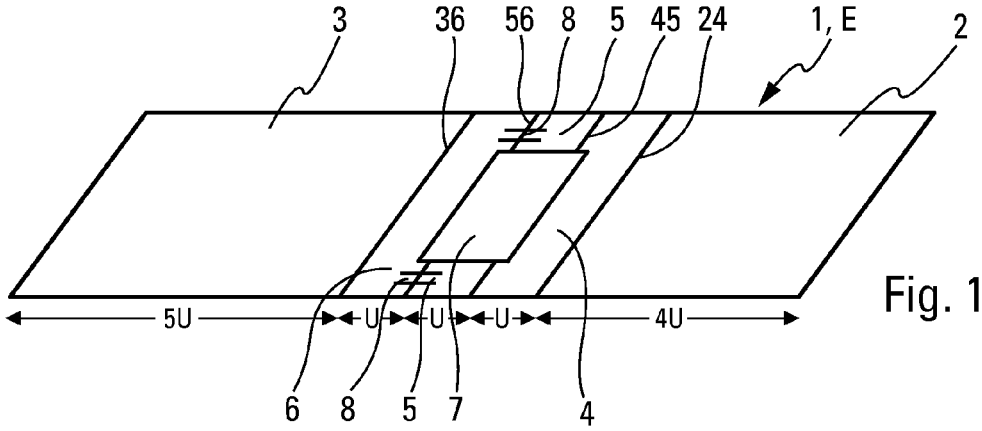
FIG. 1 is a diagrammatic perspective view of a sheet for use in fabricating the package of the dispenser assembly.

Reference is made initially to FIGS. 1 to 5 for describing in detail the structural characteristics and the fabrication of a dispenser assembly in an embodiment of the invention. In FIG. 1 there can be seen a plane sheet 1 that is to be used for making a package E of the invention. The plane sheet 1 comprises a plurality of strips 2, 3, 4, 5, and 6 that are of different widths. The strips are identical in height, since that corresponds to the height of the sheet 1. The strips are connected to one another via fold lines 24, 45, 56, 36 that form substantially right-angled edges once the package E is in its final form. The fold line 24 connects the strip 2 to the strip 4, the line 45 connects the strip 4 to the strip 5, the line 56 connects the strip 5 to the strip 6, and the line 36 connects the strip 3 to the strip 6. It can be observed that the strip 5 is interrupted by a large window 7 having side edges that extend even into the adjacent strips 4 and 6. Thus, the strip 5 is cut into two end portions that are situated at either end of the window 7. Furthermore, the strips 5 and 6 have two pairs of parallel cuts extending perpendicularly across the fold line 56. Each pair of cuts forms a blocking stop 8, as explained below with reference to FIG. 2.

In an advantageous but non-limiting embodiment of the invention, the strips 4, 5, and 6 are substantially identical in width. For reasons of simplicity, the width of these strips is written U, for "unit". Roughly speaking, U may be of cm order. Naturally, without going beyond the ambit of the invention, it is possible to envisage that the three strips 4, 5, and 6 do not present exactly the same width. With reference to U, the strip 2 presents a width of 4 U and the strip 3 presents a width of 5 U. This is merely one non-limiting embodiment and other values could be selected for the widths of the strip 2 and of the strip 3. The strip 2 may have a width of 5 U and the strip 3 may have a width of 6 U. It is also possible to imagine that the widths of the strips are not integer multiples of U, but that is not particularly advantageous. It is possible for the strip 2 to have a width of 3.5 U or 4.5 U, and for the strip 3 to have a width of 4.5 U or 5.5 U, respectively. It is important for the width of the strip 2 to be 1 U less than the width of the strip 3.

According to an advantageous characteristic of the invention, the sheet 1 is printed on only one of its faces, its other face remaining unprinted. In FIG. 1, the printed face is the bottom face that is not visible. Thus, printing the package is not expensive, unlike the package of the dispenser assembly of document FR-2 862 614.

Figure 2:
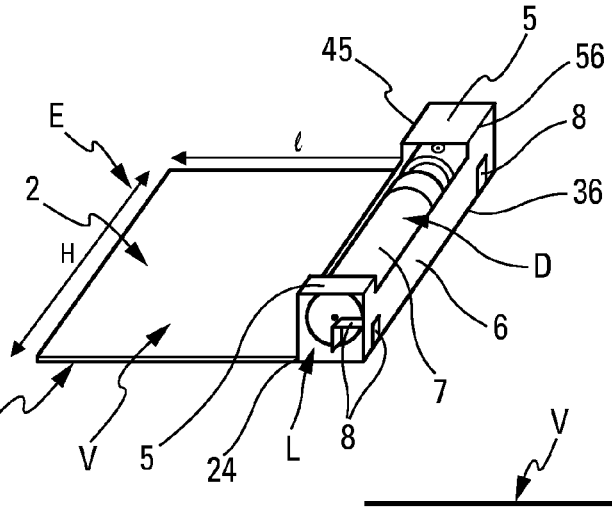
FIG. 2 is a diagrammatic perspective view of dispenser assembly in an embodiment of the invention.
Figure 4:
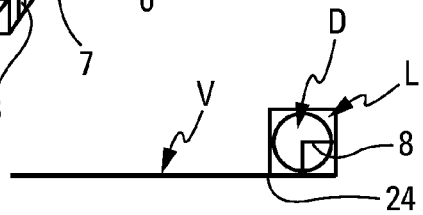
FIG. 4 is a cross-section view through the FIG. 2 dispenser assembly.
Figure 5:
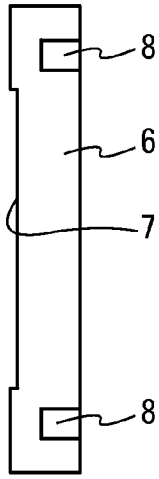
FIG. 5 is a right side view of the FIG. 2 dispenser assembly.
Figure 3:
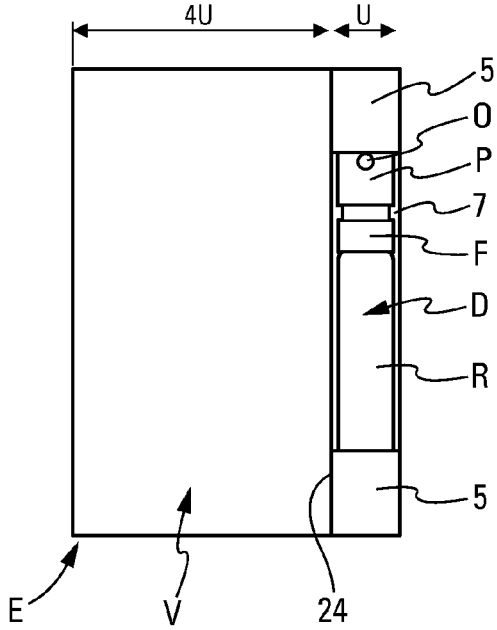
FIG. 3 is a plan view of the FIG. 2 dispenser assembly.

With reference to FIG. 2, the dispenser assembly can be seen in its final assembled state, i.e. with the sheet 1 folded approximately to form the package E. More precisely, the sheet 1 has been folded along each of its fold lines 24, 45, 56, and 36 in such a manner as to fold the sheet 1 in half with the strip 2 superposed on the strip 3. In FIG. 2, it can be seen that the strip 3 is situated underneath the strip 2 and the strip 2 is situated on top of the strip 3. The free side edges of the strips 2 and 3 are accurately aligned so as to give a suitably finished appearance. According to the invention, the two strips 2 and 3 are connected together, e.g. by adhesive bonding, heat-sealing, etc. The strips 4, 5, and 6 now form a housing L of substantially square section of side U. Thus, the housing L can be considered as forming a loop in the folded-in-half strip, and as defining internally a substantially cylindrical case into which the fluid dispenser is placed in particularly stable manner, since it is held over its entire length. Relative to the plane formed by the flap V, the strip 6 is perpendicular and vertical, the strip 5 is parallel but offset by a distance U, and the strip 4 is not visible but is perpendicular. Thus, the housing L projects upwards from the plane formed by the flap V. It is also possible to consider that the flap V is connected to the housing L via a bottom side edge of the housing that is none other than the fold line 24. Thus, the housing L projects from only one side of the flap V.

Thus, the flap V presents a height H that is the same as that of the sheet 1 and a width l that corresponds to a multiple of U, i.e. 4 U. Some other multiple could be selected without going beyond the ambit of the invention. It is even possible to envisage the width l not corresponding exactly to a multiple of U, even though that is not advantageous.

A fluid dispenser D is placed inside the housing L that forms a kind of case presenting a large window 7 through which the major fraction of the dispenser D is visible. Only the two opposite ends of the dispenser D are covered by the two segments of the strip 5. The fluid dispenser D is generally substantially cylindrical in shape, advantageously circularly cylindrical, and it comprises a small-capacity reservoir R of fluid associated with a stopper or a dispenser member such as a pump P fastened to the reservoir R via a fastening F. The pump P has a spray orifice O. In particular in FIG. 3, it can be seen that the dispenser D is almost entirely visible through the window 7.

To prevent the dispenser D sliding out from the housing L, use is made of the two small stops 8 that project into the housing L at each of the two ends of the dispenser D.

Figure 6:
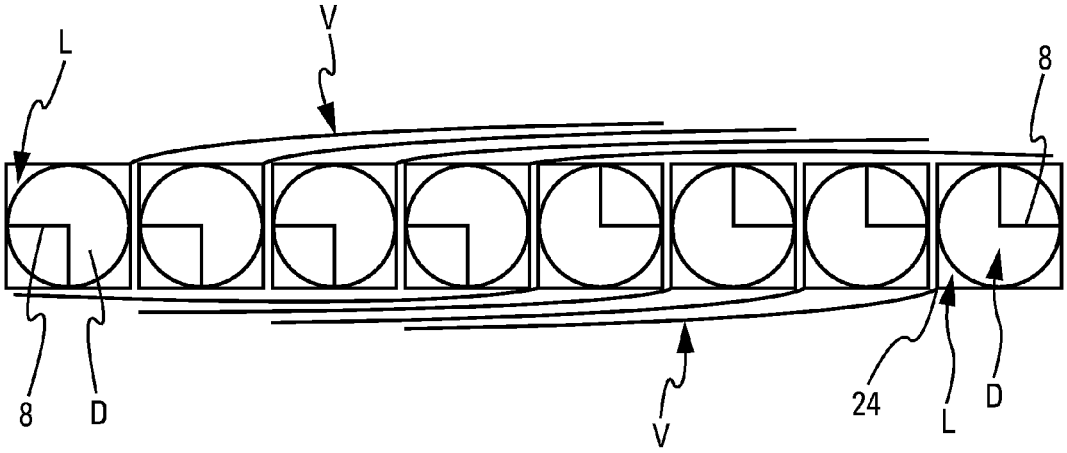
FIG. 6 is a cross-section view through a row of two groups of four dispenser assemblies packaged using the packaging method of the present invention.

Most advantageously, the structural characteristics of the dispenser assembly as described above makes it possible to provide packaging in the form of groups, of rows, and/or of blocks, as explained below. With reference initially to FIG. 6, there can be seen a row of dispenser assemblies comprising eight dispenser assemblies, which row can be subdivided into two groups of four dispenser assemblies each. The dispenser assemblies used are substantially identical to that shown in FIG. 2. Consequently, the flap V of each dispenser presents a width l that is four times greater than the side U of the housing L. Each group thus comprises four dispenser assemblies placed in such a manner that their flaps V are superposed with offsets and their housings L are disposed side by side and are oriented in the same direction. In FIG. 6, it can be seen that the dispenser assemblies of the left group have their flaps V extending over the housing L. It can also be observed that the blocking stops 8 are all oriented in the same direction. In the right group, the flaps V extend under the housings and the housings are differently oriented as can be seen by the disposition of the blocking stops 8. In other words, the four dispenser assemblies of the left group present the same orientation and the four assemblies of the right group also present the same orientation, but this orientation is inverted relative to that to the left group. It is also possible to say that the two groups are disposed opposite ways round. Although the housings are differently oriented from one group to the other, all of the housings in the row are properly aligned, and it is only the inverse orientations of the stop 8 that makes it possible to see that they do not have the same orientation. The flaps V are distributed in entirely equal manner on either side of the row of housings L, with four flaps V on either side. An interesting characteristic lies in the fact that the flap of the dispenser assembly that is in contact with the other group does not extend beyond the last housing of the dispenser assembly. In other words, the flaps do not project beyond the housings in the row. More precisely, the free side edges of the end flaps are in alignment with the outsides of the end housings. This can clearly be seen in FIG. 6. This characteristic comes directly from the fact that the width of the flaps corresponds to a multiple of the side of the square housings, and the number of dispenser assemblies in each group is equal to that multiple. Specifically, the multiple is 4. The width of a flap corresponds to four times the side of the housing such that it extends over four housings and stops in alignment with the outside edge of the last housing. This produces packaging that is perfectly compact with all four corners being defined solely by the housings, and not by the projecting edges of the flaps, as happens in the above-mentioned prior art document.

Starting from the packaging in the form of rows, it is then possible to build up a block made up of m rows. In the particular embodiment shown in FIG. 7, m is equal to 8, corresponding to twice the multiple (4) of the side U of the housing, so there are 64 dispenser assemblies in the block of FIG. 7. More mathematically speaking, it is possible to say that it is advantageous to make up a block of $2\times n^2$ dispenser assemblies, where n is the multiple of U corresponding to the width l of the flap. It can be immediately be observed in FIG. 7 that the flaps of the dispenser assemblies do not project from the sides, so they do not run any risk of being damaged. In order to come as close as possible to the shape of a cube, it is preferable to make up a block or bundle using only six or seven rows, given that account needs to be taken in the thickness direction of a row of eight side flaps in superposition, i.e. four superposed flaps on either side: assuming that the height H of the flap V is about 8 cm and that U is equal to 1 cm, it is possible for example to package 8×7=56 dispenser assemblies in the form of a compact cube-shaped block measuring approximately 8 cm×8 cm×8 cm.

Figure 7:
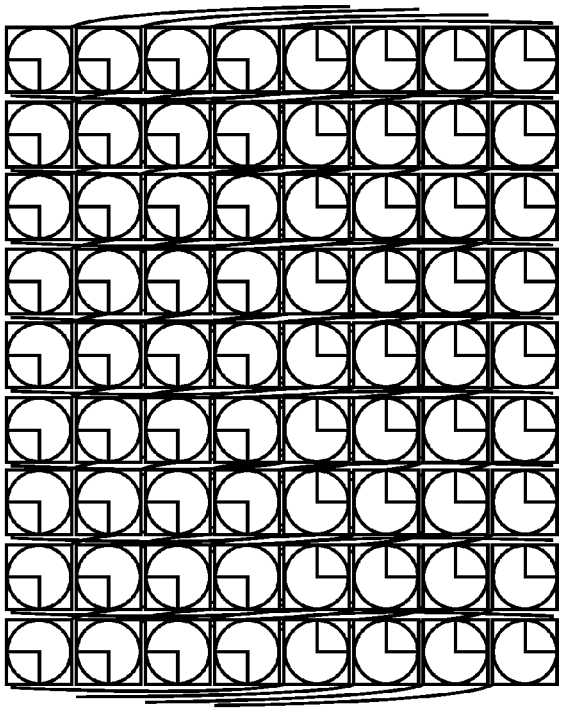
FIG. 7 is a cross-section view through a block constituted by eight rows each constituted by two groups of four dispenser assemblies, giving a total of 64 dispenser assemblies.

Although it is particularly advantageous to dimension the flap with a width l corresponding to a multiple of the side U of the housing L, it is also possible, without going beyond the ambit of the invention, to select a width l that is not a multiple of U. Under such circumstances, it is nevertheless preferable for l to be less than n×U, so as to avoid the free side edges of the flaps projecting beyond the housings L in a row, as shown in FIG. 6, or in a block, as shown in FIG. 7.

As can be seen above, the structural characteristics of the dispenser assembly, and in particular the dimensional relationships between l and U, make it possible to implement a packaging method that is particularly advantageous, whether in the form of forms or of blocks.

The invention claimed is:

1. A method of packaging dispenser assemblies each dispenser assembly comprising a fluid dispenser of generally cylindrical shape; and a package defining a housing for the dispenser and a single side flap that extends from one side of the housing from a bottom side edge of the housing, such that the housing projects entirely from one side only of the plane defined by the flap, the housing presenting a cross-section that is substantially a square having side length equal to U, the flap presenting a height parallel to the bottom side edge and a width having a length equal to l perpendicular to the edge, the width length l corresponding substantially to a multiple of U;

the method comprising forming a group of n dispenser assemblies disposed in such a manner that the flaps are stacked and the housings are in side-by-side alignment and oriented in the same direction, the method further comprising including a row constituted by two identical groups disposed in an opposite ways round configuration such that the stacked flaps of one group extend over the aligned housings of the other group, and vice versa, so that all of the housings are in side-by-side alignment, but differently oriented from one group to the other.

2. A method according to claim 1, wherein the housing (L) includes blocking means (8) for retaining the dispenser (D) in the housing, and a window (7) through which the major fraction of the dispenser is visible.

3. A method according to claim 1, wherein the package (E) is made from a single sheet (1) folded in half so that the flap (V) is formed by superposing two strips (2, 3) of the sheet with the housing (L) being formed by a closed loop of the sheet.

4. A method according to claim 1, wherein the housing (L) forms a case presenting a large window (7) the case covering only the two opposite ends of the dispenser.

5. A method according to claim 1, wherein the sheet (1) is printed on only one of its faces.

6. A packaging method according to claim 1, wherein n corresponds substantially to l/U.

7. A packaging method according to claim 1, comprising stacking m rows to form a compact block of m×2×n dispenser assemblies.

8. A packaging method according to claim 1, wherein the width l of the flaps (V) is less than n×U, such that the flaps do not project sideways beyond the housings in a row.

* * * * *